US008532552B2

(12) United States Patent
Fujiwara et al.

(10) Patent No.: US 8,532,552 B2
(45) Date of Patent: Sep. 10, 2013

(54) FIXING DEVICE INCLUDING REFLECTING PLATE WITH TILTED ENDS

(75) Inventors: Yasushi Fujiwara, Itami (JP); Tsuneo Fujiwara, legal representative, Hyogo (JP); Etsuko Fujiwara, legal representative, Hyogo (JP); Kei Ishida, Aichi (JP); Noboru Suzuki, Komaki (JP); Takuji Matsuno, Ichinomiya (JP); Tomohiro Kondo, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 270 days.

(21) Appl. No.: 12/915,283

(22) Filed: Oct. 29, 2010

(65) Prior Publication Data

US 2011/0164905 A1 Jul. 7, 2011

(30) Foreign Application Priority Data

Oct. 30, 2009 (JP) ..... 2009-250063

(51) Int. Cl.
*G03G 15/20* (2006.01)

(52) U.S. Cl.
USPC ..... 399/329; 399/328; 399/334

(58) Field of Classification Search
USPC ..... 219/216; 399/328, 329, 334, 336
See application file for complete search history.

(56) References Cited

U.S. PATENT DOCUMENTS

2009/0010688 A1* 1/2009 Takahashi et al. ..... 399/328

FOREIGN PATENT DOCUMENTS

JP 2008-292585 12/2004

* cited by examiner

*Primary Examiner* — Hoang Ngo
(74) *Attorney, Agent, or Firm* — Banner & Witcoff, Ltd.

(57) ABSTRACT

A fixing device includes a heating element disposed inside a flexible fusing member, a nip member disposed to contact with a surface of the flexible fusing member and to allow the flexible fusing member to slide along the nip member, a reflecting plate for reflecting radiant heat from the heating element toward the nip member, and a backup member for nipping the flexible fusing member with the nip member. The reflecting plate includes a central reflecting portion extending along a longitudinal direction of the heating element at least in a region corresponding to along a heat generating portion of the heating element, and end reflecting portions stationarily provided on both ends of the central reflecting portion. The end reflecting portions are disposed in positions longitudinally outward of the heat generating portion and each has a reflecting surface tilted with respect to the longitudinal direction of the heating element.

19 Claims, 6 Drawing Sheets

FIXING DEVICE INCLUDING REFLECTING PLATE WITH TILTED ENDS

CROSS-REFERENCE TO RELATED APPLICATION(S)

This application claims priority from Japanese Patent Application No. 2009-250063 filed on Oct. 30, 2009, the disclosure of which is incorporated herein by reference in its entirety.

TECHNICAL FIELD

The present invention relates to a fixing device for thermally fixing a developer image transferred onto a recording sheet.

BACKGROUND ART

A fixing device for use in an electrophotographic image forming apparatus is known in the art, which includes an endless film, an infrared heater (heating element), and a reflecting plate for reflecting infrared radiation from the infrared heater toward a heating plate. In such a fixing device, if printing for small-sized recording media is carried out continuously, the temperature increases too much at both end portions of the heating plate where the recording media do not pass through. For this reason, an end-side rotatable reflecting plate is provided so that the radiant heat emitted from the infrared heater can be reflected by the rotatable reflecting plate toward a center portion of the heating plate.

However, if a fixing device is designed to reflect the radiant heat emitted from the infrared heater toward a printing area on small-sized recording media as with the aforementioned fixing device, it is necessary to dispose the end-side rotatable reflecting plate a large distance away from the infrared heater in order to keep a space required for movement of the end-side rotatable reflecting plate. This disadvantageously leads to an extremely large-sized device.

Further, according to the aforementioned fixing device, when a small-sized recording medium is printed, the end-side rotatable reflecting plate is tilted inward. However, in other cases, such as during printing of recording media other than those small-sized media, the radiant heat emitted from the infrared heater flows outwardly in a width direction (including diagonal directions) of a recording medium and leaks to the outside, so that the heat from the infrared heater is not effectively utilized.

It would thus be desirable to provide a fixing device which is compact and can effectively utilize the radiant heat emitted from the heating element.

SUMMARY OF THE INVENTION

According to a first aspect of the present invention, there is provided a fixing device for thermally fixing a developer image transferred onto a recording sheet, which comprises: a tubular fusing film; a heating element disposed inside the fusing film; a nip member disposed in such a manner as to contact with an inner surface of the fusing film and to allow the fusing film to slide along the nip member; a reflecting plate configured to reflect radiant heat from the heating element in a direction toward the nip member; and a backup member configured to nip the fusing film with the nip member to thereby form a nip portion for the recording sheet between the fusing film and the backup member. In this fixing device, the reflecting plate includes: a central reflecting portion extending along a longitudinal direction of the heating element at least in a region corresponding to a heat generating portion of the heating element and along the heat generating portion; and end reflecting portions stationarily provided on both ends of the central reflecting portion, the end reflecting portions being disposed with respect to the heating element in positions longitudinally outward of the heat generating portion such that radiant heat emitted from the heat generating portion is reflected by the end reflecting portions and directed longitudinally inward of ends of the reflecting plate.

According to a second aspect of the present invention, there is provided a fixing device for thermally fixing a developer image transferred onto a recording sheet, which comprises: a tubular fusing film; a heating element disposed inside the fusing film; a nip member disposed in such a manner as to contact with an inner surface of the fusing film and to allow the fusing film to slide along the nip member; a reflecting plate configured to reflect radiant heat from the heating element in a direction toward the nip member; and a backup member configured to nip the fusing film with the nip member to thereby form a nip portion for the recording sheet between the fusing film and the backup member. In this fixing device, the reflecting plate includes: a central reflecting portion extending along a longitudinal direction of the heating element at least in a region corresponding to a heat generating portion of the heating element and along the heat generating portion; and end reflecting portions stationarily provided on both ends of the central reflecting portion, the end reflecting portions being disposed with respect to the heating element in positions longitudinally outward of the heat generating portion and each having a reflecting surface tilted with respect to the longitudinal direction of the heating element.

According to a third aspect of the present invention, there is provided a fixing device for thermally fixing a developer image transferred onto a recording sheet, comprising: a flexible fusing member which is flexibly deformable; a heating element disposed inside the flexible fusing member; a nip member disposed in such a manner as to contact with a surface of the flexible fusing member and to allow the flexible fusing member to slide along the nip member; a reflecting plate configured to reflect radiant heat from the heating element in a direction toward the nip member; and a backup member configured to nip the flexible fusing member with the nip member to thereby form a nip portion for the recording sheet between the flexible fusing member and the backup member, wherein the reflecting plate includes: a central reflecting portion extending along a longitudinal direction of the heating element at least in a region corresponding to a heat generating portion of the heating element and along the heat generating portion; and end reflecting portions stationarily provided on both ends of the central reflecting portion, the end reflecting portions being disposed with respect to the heating element in positions longitudinally outward of the heat generating portion and each having a reflecting surface tilted with respect to the longitudinal direction of the heating element.

According to the present invention, the term "heat generating portion" indicates that portion of the heating element which actually generates heat (e.g., an infrared radiation portion and a far infrared radiation portion).

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENTS

A detailed description will be given of illustrative embodiments of the present invention with reference to the drawings. In the following description, a general arrangement of a laser printer 1 (image forming apparatus) provided with a fixing device 100 according to one embodiment of the present invention will be described, and thereafter features of the fixing device 100 will be described in detail.

<General Arrangement of Laser Printer>

Figure 1:
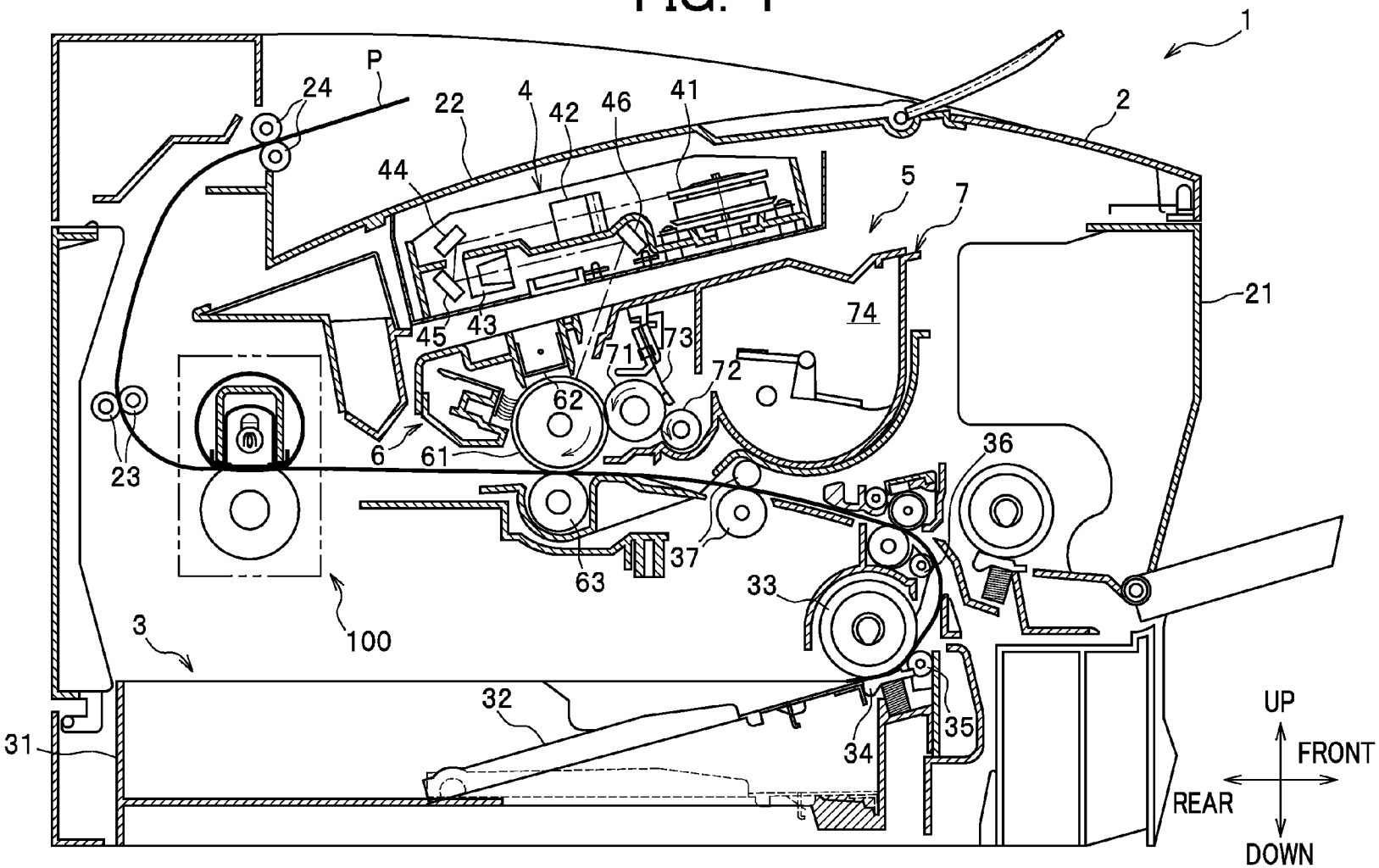
FIG. 1 is a schematic diagram of a laser printer provided with a fixing device according to an exemplary embodiment of the present invention.

As shown in FIG. 1, a laser printer 1 comprises a body casing 2, and several components housed within the body casing 2 which principally include a sheet feeder unit 3 for feeding a sheet P (e.g., of paper) as one example of a recording sheet, an exposure device 4, a process cartridge 5 for transferring a toner image (developer image) onto the sheet P, and a fixing device 100 for thermally fixing the toner image transferred onto the sheet P.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction extending from top to bottom of the drawing sheet corresponds to the "vertical" or "up/down (upper/lower or top/bottom)" direction of the printer.

The sheet feeder unit 3, provided in a lower space within the body casing 2, principally includes a sheet feed tray 31 for storing sheets P, a sheet pressure plate 32 for pushing up front sides of the sheets P, a sheet feed roller 33, a sheet feed pad 34, paper powder remover rollers 35, 36, and registration rollers 37. Sheets P in the sheet feed tray 31 are pressed against the sheet feed roller 33 by the sheet pressure plate 32, and each sheet P, separated from the others by the sheet feed roller 33 and the sheet feed pad 34, is conveyed through the paper powder remover rollers 35, 36 and the registration roller 37 into the process cartridge 5.

The exposure device 4 is provided in an upper space within the body casing 2, and principally includes a laser beam emitter (not shown), a polygon mirror 41 configured to be driven to spin, lenses 42, 43, and reflecting mirrors 44, 45, 46. The exposure device 4 is configured to cause a laser beam produced based upon image data to travel along a path indicated by alternate long and short dashed lines, by reflecting or transmitting the same at the polygon mirror 41, the lens 42, the reflecting mirrors 44, 45, the lens 43, and the reflecting mirror 46 in this order, so that a peripheral surface of a photoconductor drum 61 is rapidly scanned and illuminated consecutively with the laser beam.

The process cartridge 5 is disposed below the exposure device 4 within the body casing 2, and configured to be installable in and removable from the body casing 2 through an opening formed when a front cover 21 provided at the body casing 2 is swung open. The process cartridge 5 includes a drum unit 6 and a development unit 7.

The drum unit 6 principally includes a photoconductor drum 61, a charger 62, and a transfer roller 63. The development unit 7 is configured to be detachably attached to the drum unit 6. The development unit 7 principally includes a development roller 71, a supply roller 72, a doctor blade 73, and a toner reservoir 74 which is configured to store toner (developer) therein.

In the process cartridge 5, the peripheral surface of the photoconductor drum 61 is uniformly charged by the charger 62, and then exposed to a rapidly sweeping laser beam from the exposure device 4 so that an electrostatic latent image based upon image data is formed on the photoconductor drum 61. Meanwhile, toner in the toner reservoir 74 is supplied via the supply roller 72 to the development roller 71, and goes through between the development roller 71 and the doctor blade 73 so that a thin layer of toner having a predetermined thickness is carried on the development roller 71.

The toner carried on the development roller 71 is supplied to the electrostatic latent image formed on the photoconductor drum 61. Accordingly, the electrostatic latent image is visualized and a toner image is formed on the photoconductor drum 61. Thereafter, while a sheet P is conveyed through between the photoconductor drum 61 and the transfer roller 63, the toner image on the photoconductor drum 61 is transferred onto the sheet P.

The fixing device 100 is provided rearwardly of the process cartridge 5. The toner image (toner) transferred onto the sheet P is thermally fixed on the sheet P while passing through the fixing device 100. The sheet P with the toner image thermally fixed thereon is ejected by conveyor rollers 23, 24 onto a sheet output tray 22.

<Detailed Structure of Fixing Device>

Figure 2:
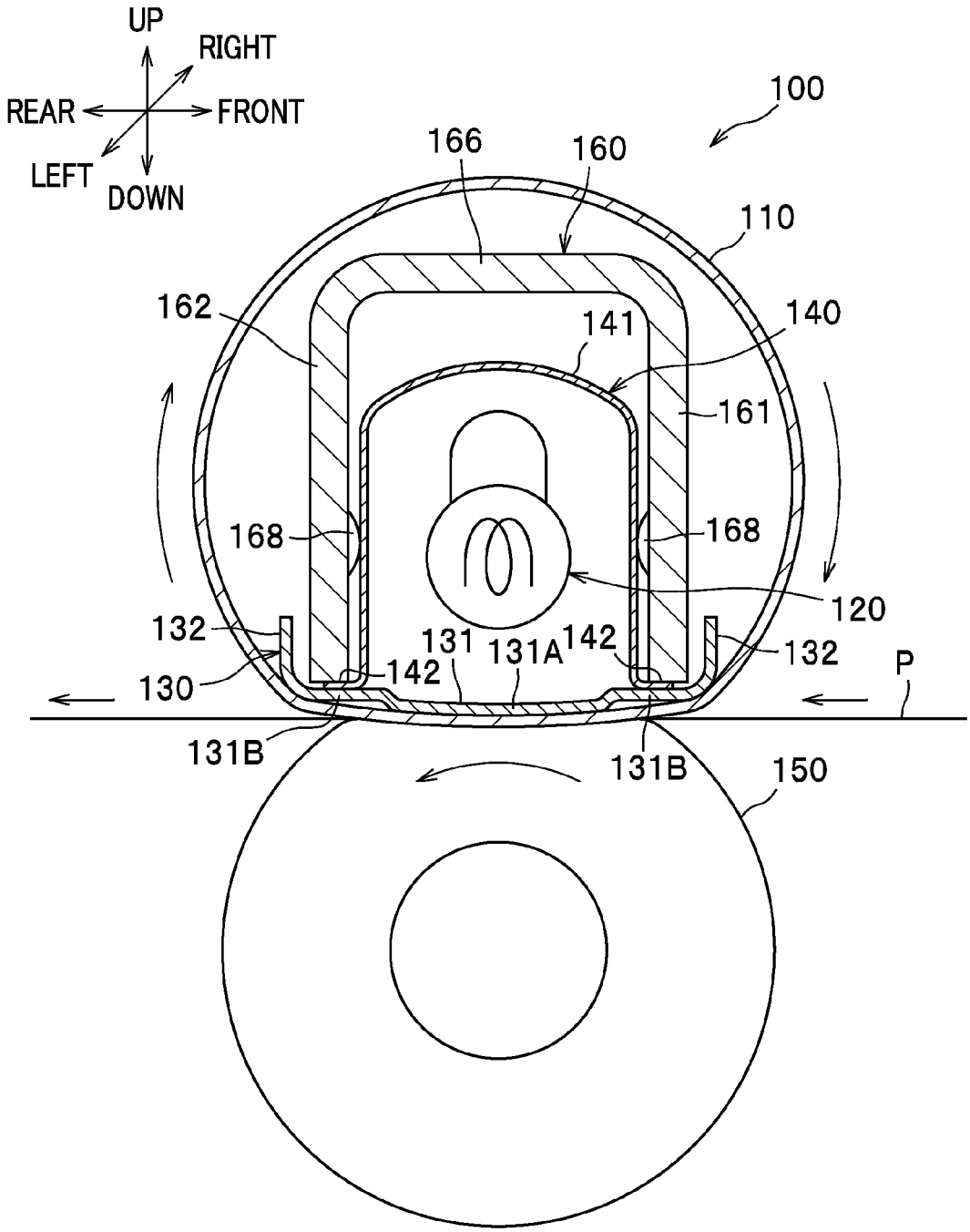
FIG. 2 is a schematic section of a fixing device according to an exemplary embodiment of the present invention.

As shown in FIG. 2, the fixing device 100 principally includes a fusing film 110 as one example of a flexible fusing member, a halogen lamp 120 as one example of a heating element, a nip plate 130 as one example of a nip member, a reflecting plate 140, a pressure roller 150 as one example of a backup member, and a stay 160.

In the following description, a conveyance direction of a sheet P (i.e., substantially front-rear direction) will be referred to simply as a "sheet conveyance direction", and a longitudinal direction (i.e., substantially right-left direction) of a component such as the halogen lamp 120 (heat generating portion H), the nip plate 130, and the reflecting plate 140 will be referred to simply as a "longitudinal direction". Further, a pressing direction along which the pressure roller 150 applies a pressing force (i.e., substantially an upward-downward direction) will be referred to simply as a "pressing direction".

The fusing film 110 is an endless (tubular) film having thermostability and flexibility. Rotation of the fusing film 110 is guided by a guide member (not shown) provided at both longitudinal end portions of the fusing film 110.

The halogen lamp 120 is a known heating element configured to heat the nip plate 130 and the fusing film 110 to thereby heat toner on the sheet P. For example, the halogen lamp 120 includes a glass tube, and a heating resistor disposed inside the glass tube. The halogen lamp 120 is disposed inside the fusing film 110, and spaced a predetermined distance apart from inner surfaces of the fusing film 110 and the nip plate 130.

Figure 3:
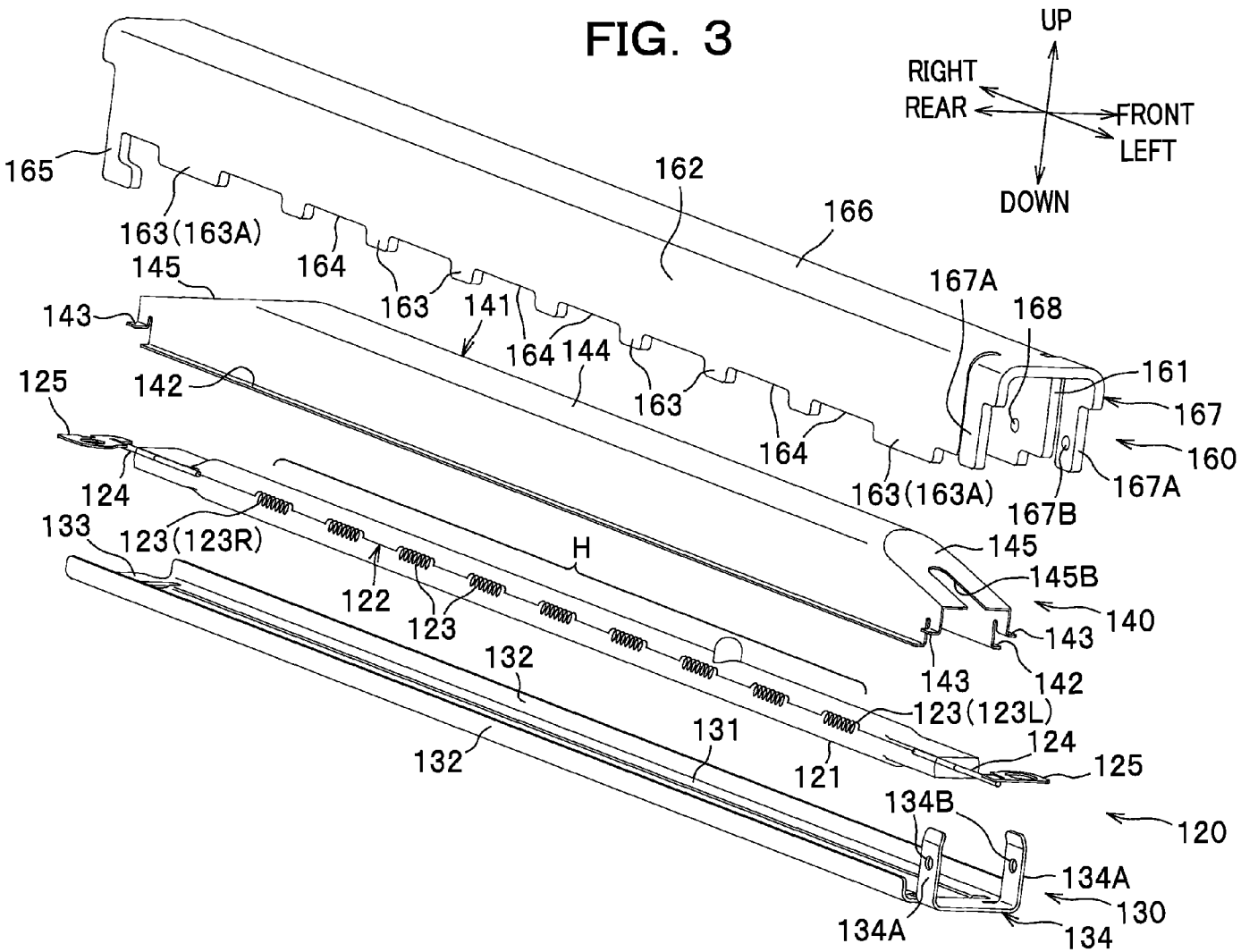
FIG. 3 is a perspective view showing a halogen lamp, a nip plate, a reflecting plate, and a stay, as disassembled.

As shown in FIG. 3, the halogen lamp 120 includes a thin and narrow tubular-shaped glass tube 121, and a filament 122 disposed in the glass tube 121. Both longitudinal end portions of the glass tube 121 are sealed for filling an inert gas containing halogen in the glass tube 121. The filament 122 has a plurality of helically wound coil portions 123.

The halogen lamp 120 has a pair of rod-shaped electrodes 124 extending longitudinally at the both end portions of the glass tube 121 and protruding outward from both right and left ends of the glass tube 121. Each of the electrodes 124 is electrically connected to the filament 122 at its inner end, and also to a terminal 125 at its outer end.

In this embodiment, the halogen lamp 120 provides a portion which principally generates heat (hereinafter referred to as a "heat generating portion" H). The heat generating portion H extends from the left-most coil portion 123L to the right-most coil portion 123R. To be more specific, that portion of the halogen lamp 120 which extends from an outer end of the coil portion 123L to an outer end of the coil portion 123R functions as the heat generating portion H.

As shown in FIG. 2, the nip plate 130 is a plate-like member configured to receive a pressing force of the pressure roller 150 and to transmit radiant heat from the halogen lamp 120 through the fusing film 110 to the toner on the sheet P. The nip plate 130 is disposed in such a manner as to contact with an inner surface of the tubular fusing film 110 and to allow the fusing film to slide along the nip plate 130. The nip plate 130 is in contact with the fusing film 110 with lubricant G (e.g., grease) applied between the nip plate 130 and the fusing film 110 so as to make the fusing film 110 smoothly slidable.

The nip plate 130 has a thermal conductivity greater than a steel stay 160 to be described later. The nip plate 130 is formed, for example, by bending an aluminum plate or the like into a substantially U-shaped cross sectional form. To be more specific, as viewed in section, the nip plate 130 principally includes a base portion 131 and bent portions 132. The base portion 131 is disposed between the bent portions 132 and extends along the sheet conveyance direction, and the bent portions 132 extend upward at both ends of the base portion 131.

Figure 4:
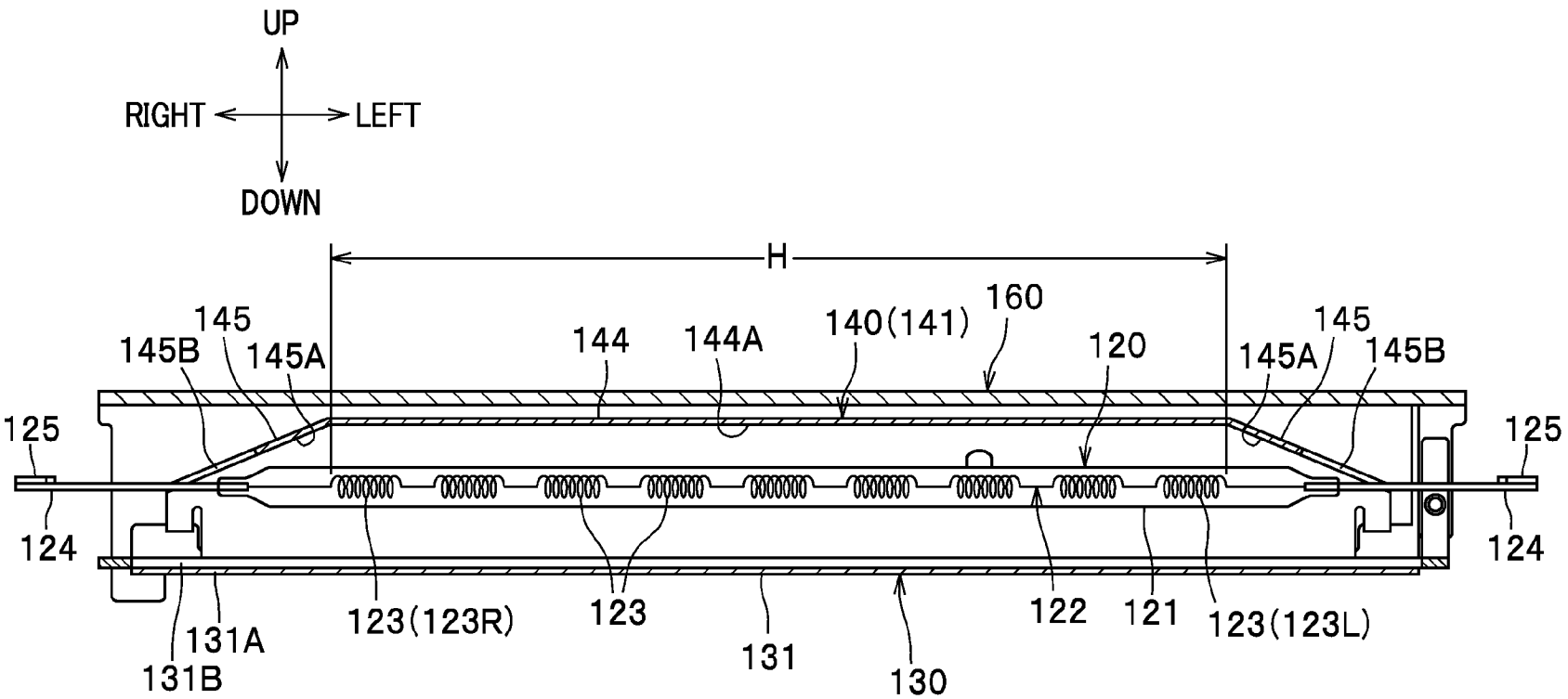
FIG. 4 is a sectional view showing the halogen lamp, the nip plate, the reflecting plate, and the stay, as assembled.

The base portion 131 includes a central portion 131A and both end portions 131B (i.e., front and rear portions in positions upstream and downstream, respectively, with respect to the sheet conveyance direction). The central portion 131A protrudes downward from the both end portions 131B toward the pressure roller 150. As shown in FIG. 4, the base portion 131 has a length longer than the heat generating portion H of the halogen lamp 120, so that it can be disposed along the longitudinal direction of the halogen lamp 120 extending outwardly beyond the heat generating portion H. An inner surface (upper surface) of the base portion 131 may be painted black, or provided with a heat absorptive member. This makes the base portion 131 of the nip plate 130 more efficient in absorbing radiant heat from the halogen lamp 120.

As shown in FIG. 3, the nip plate 130 includes an insertion portion 133 extending from a right end of the base portion 131, and an engagement portion 134 formed on a left end of the base portion 131. The engagement portion 134 has a U-shaped cross section, and engageable holes 134B are provided in upwardly-bent sidewall portions 134A of the engagement portion 134.

As shown in FIG. 2, the reflecting plate 140 is a member configured to reflect radiation of heat from the halogen lamp 120 toward the nip plate 130 (the inner surface of the base portion 131). The reflecting plate 140 is made from a metal plate and extends in the axial direction of the fusing film 110. The reflecting plate 140 is disposed inside the fusing film 110 to surround the halogen lamp 120, in a position spaced a predetermined distance apart from the halogen lamp 120.

The reflecting plate 140 is designed to collect radiant heat from the halogen lamp 120 to the nip plate 130, and thus the radiant heat from the halogen lamp 120 can be efficiently utilized so that the nip plate 130 and the fusing film 110 can be heated quickly.

The reflecting plate 140 is formed, for example, of an aluminum plate or the like having a high reflectance of infrared and far-infrared radiation by curving the same to have a U-shaped cross section. To be more specific, the reflecting plate 140 principally includes a reflecting portion 141 having a curved shape (i.e., substantially U-shaped cross section), and flange portions 142 extending in the sheet conveyance direction from both ends of the reflecting portion 141. In order to increase the reflectance of radiant heat, the reflecting plate 140 may be formed of a mirror-finished aluminum plate.

As shown in FIG. 3, the reflecting portion 141 includes a central reflecting portion 144 disposed centrally along the longitudinal direction, and both end reflecting portions 145 extending longitudinally outward from both ends of the central reflecting portion 144. The both end reflecting portions 145 are formed integrally with the central reflecting portion 144 by pressing a metal plate.

As shown in FIG. 4, the central reflecting portion 144 extends along the longitudinal direction of the halogen lamp 120 in a region corresponding to the heat generating portion H (i.e., substantially at the same length of the heat generating portion H) of the halogen lamp 120 in a direction substantially parallel to and along the heat generating portion H. The central reflecting portion 144 has a surface facing to the halogen lamp 120, and this surface provides a reflecting surface 144A that is substantially parallel to the heat generating portion H extending in the right-left direction.

The both end reflecting portions 145 are disposed longitudinally outward of the heat generating portion H of the halogen lamp 120 such that radiant heat emitted from the heat generating portion H is reflected by the end reflecting portions 145 and directed longitudinally inward of both ends of the reflecting plate 140. Each end reflecting portion 145 has a surface facing to the halogen lamp 120 and extending longitudinally outward from the reflecting surface 144A of the central reflecting portion 144 so as to gradually approach the halogen lamp 120, and this surface provides a reflecting surface 145A that is tilted with respect to the longitudinal direction of the halogen lamp 120.

Further, as shown in FIG. 3, the both end reflecting portions 145 are formed such that they are apart from the corresponding electrodes 124. To be more specific, a cut portion 145B is formed in a longitudinally outer end portion of each end reflecting portion 145, so that when the halogen lamp 120 is positioned inside the reflecting plate 140, the electrodes 124 are kept out of contact with the end surfaces of the both end reflecting portions 145.

Since the central reflecting portion 144 and the both end reflecting portions 145 are made from a single aluminum plate or the like, the both end reflecting portions 145 are stationary with respect to the central reflecting portion 144. In other words, the both end reflecting portions 145 are immovable with respect to the central reflecting portion 144.

Figure 5:
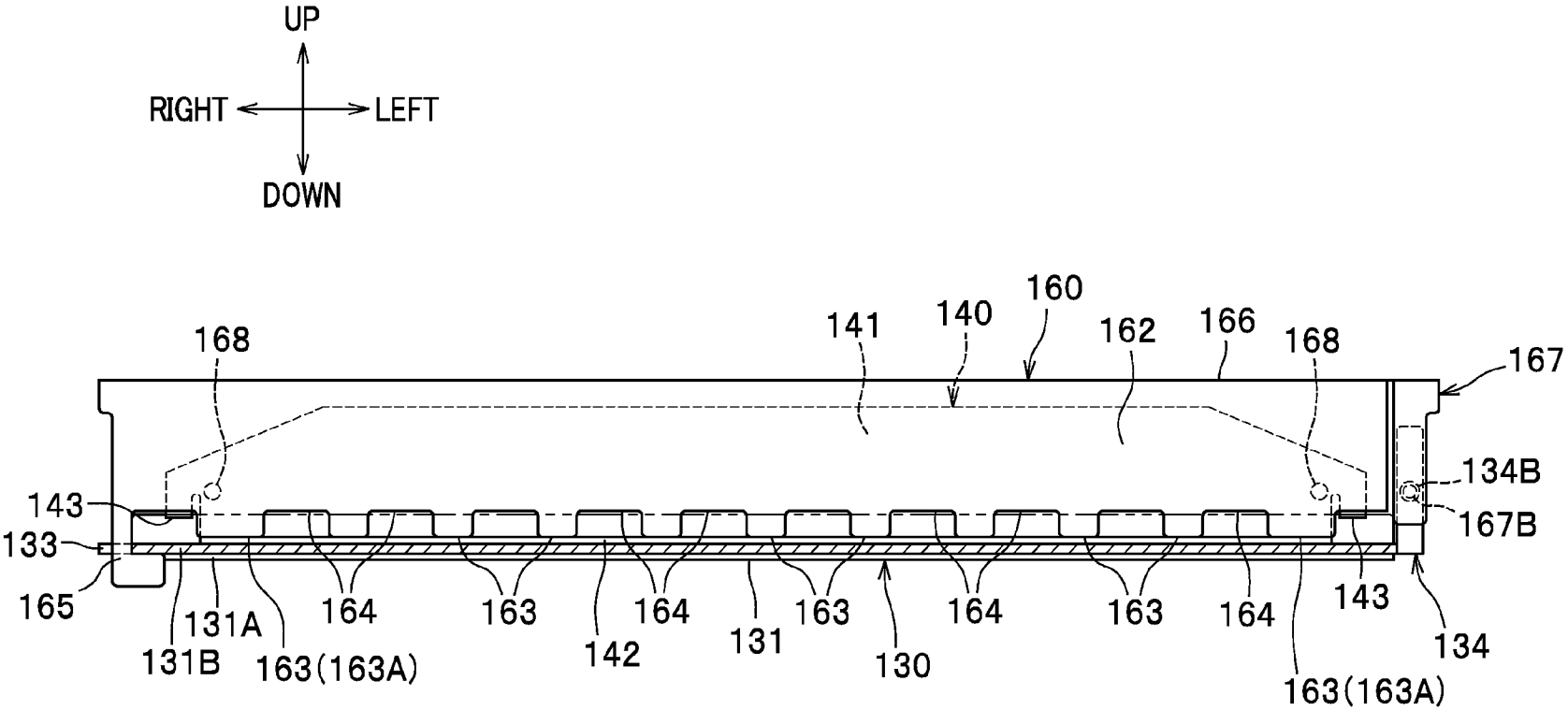
FIG. 5 is a front view showing the nip plate, the reflecting plate, and the stay, as assembled.

As shown in FIG. 3, four stopper portions 143 (of which three are shown) each shaped like a flange are formed at both right and left longitudinal ends of the reflecting plate 140 (i.e., at the ends of the length of the longitudinally disposed reflecting plate 140). The stopper portions 143 are located above the flange portions 142, and designed such that, as shown in FIG. 5, when the nip plate 130, the reflecting plate 140 and the stay 160 are assembled together, a plurality of contact portions 163 of the stay 160 which will be described later are sandwiched between the stopper portions 143 (i.e., the stopper portions come in contact with outer sides of the outermost contact portions 163A of the contact portions 163 arranged along the longitudinal direction).

With this configuration, even when the reflecting plate 140 tends to move to the left or to the right by some reason such as vibration produced during the operation of the fixing device 100, the reflecting plate 140 is restricted in its movements in the longitudinal direction because the stopper portions 143 of the reflecting plate 140 come in contact with the respective contact portions 163A. As a result, an undesirable displacement of the reflecting plate 140 in the longitudinal direction can be restricted effectively.

As shown in FIG. 2, the pressure roller 150 is configured such that the fusing film 110 is nipped between the pressure roller 150 and the nip plate 130 to form a nip portion between the fusing film 110 and the pressure roller 150. The pressure roller 150 is disposed below the nip plate 130. To be more specific, the pressure roller 150 is configured to press the nip plate 130 through the fusing film 110 to thereby form the nip portion between the fusing film 110 and the pressure roller 150.

The pressure roller 150 is configured to be driven to rotate by a driving force transmitted from a motor (not shown) provided in the body casing 2. Rotation of the pressure roller 150 causes the fusing film 110 to rotate, following the rotational movement of the pressure roller 150, with the help of frictional force with the fusing film 110 (or a sheet P as conveyed).

A sheet P with a toner image transferred thereon is conveyed through between the pressure roller 150 and the heated fusing film 110 (through the nip portion), so that the toner image (toner) is thermally fixed on the sheet P.

The stay 160 is configured to support the both end portions 131B of the nip plate 130 (base portion 131) located in positions upstream and downstream, respectively, with respect to the sheet conveyance direction, to thereby reinforce the nip plate 130. The stay 160 is shaped to follow the contour of the reflecting plate 140 (the central reflecting portion 144) to have a substantially U-shaped cross section and provided to sheathe the reflecting plate 140. The stay 160 like this may be formed, for example, by bending a steel plate or the like having a relatively great rigidity into a substantially U-shaped cross sectional form.

At a lower end portion of each of front and rear wall portions 161, 162 of the stay 160, as shown in FIG. 3, a plurality of contact portions 163 are provided which are shaped substantially like the teeth of a comb with recess portions 164 positioned therebetween.

At the right end portion of each of the front and rear wall portions 161, 162 of the stay 160, a substantially L-shaped stopper portion 165 is provided which extends downward from the lower side of the right end portion and then extends leftward. Furthermore, at the left end portion of the stay 160, a holding portion 167 is provided which is bent into a substantially U-shaped cross sectional form, having an upper wall extension portion extending leftward from an upper wall portion 166 of the stay 160 and both side wall portions 167A extending downwardly from both side edges of the upper wall extension portion. At an inner surface of each side wall portion 167A of the holding portion 167, an engageable boss 167B is provided (only one of them is illustrated) which protrudes inwardly.

As shown in FIGS. 2 and 3, on inner surfaces of the front wall portion 161 and the rear wall portion 162, the total of four abutment bosses 168 are provided in a manner protruding inwardly at the right and left longitudinal end portions of the stay 160. These abutment bosses 168 abut on the reflecting plate 140 (the reflecting portion 141 thereof) from the upstream and downstream sides with respect to the sheet conveyance direction. With this configuration, even when the reflecting plate 140 tends to move to the front or to the rear by some reason such as vibration produced during the operation of the fixing device 100, the reflecting plate 140 is restricted in its movements in the sheet conveyance direction because the abutment bosses 168 come in contact with the reflecting portion 141. As a result, an undesirable displacement of the reflecting plate 140 in the sheet conveyance direction can be restricted effectively.

When the reflecting plate 140 and the nip plate 130 are assembled with the stay 160 as described above, first, the reflecting plate 140 is fitted in the stay 160. Since the abutment bosses 168 are provided on the inner surfaces of the front wall portion 161 and the rear wall portion 162 of the stay 160, the abutment bosses 168 abut on the reflecting plate 140 so that the reflecting plate 140 is provisionally held inside the stay 160.

Thereafter, as shown in FIG. 5, the insertion portion 133 of the nip plate 130 is inserted between the stopper portions 165 of the stay 160 so that the base portion 131 (both end portions 131B) engages with the stopper portions 165. Then, the engagement portion 134 (engageable holes 134B) of the nip plate 130 is engaged with the holding portion 167 (engageable bosses 167B) of the stay 160.

Accordingly, the nip plate 130 is supported on the stay 160 with the both end portions 131B of the base portion 131 being supported by the stopper portions 165 and with the engagement portion 134 being held by the holding portion 167. The reflecting plate 140 is also supported on and held inside the stay 160 with the flange portions 142 being held between the nip plate 130 and the stay 160.

In this embodiment, the reflecting plate 140 is supported with the flange portions 142 held between the nip plate 130 and the stay 160. Therefore, even when the reflecting plate 140 tends to move upward or downward by some reason such as vibration produced during the operation of the fixing device 100, the reflecting plate 140 is restricted in its movements in the pressing direction. As a result, an undesirable displacement of the reflecting plate 140 in the pressing direction can be restricted effectively so that the position of the reflecting plate 140 relative to the nip plate 130 can be fixed securely.

Although not illustrated in the drawings, the stay 160, on which the nip plate 130 and the reflecting plate 140 are supported, and the halogen lamp 120 are held by a guide member adapted to guide the rotation of the fusing film 110. This guide member is mounted in the casing (not shown) of the fixing device 100, so that the fusing film 110, the halogen lamp 120, the nip plate 130, the reflecting plate 140, and the stay 160 are held in the casing of the fixing device 100.

With the configuration as described above according to the present embodiment, the following advantageous effects can be achieved.

Since the central reflecting portion 144 of the reflecting plate 140 extends along the longitudinal direction of the halogen lamp 120 in the region corresponding to the heat generating portion H of the halogen lamp 120 and along the heat generating portion H, the reflecting plate 140 can be positioned relatively close to the halogen lamp 120. This can prevent the device from being enlarged and therefore provide a compact-sized fixing device 100.

Further, the reflecting plate 140 includes end reflecting portions 145 stationarily provided on both ends of the central reflecting portion 144, and the end reflecting portions 145 are disposed with respect to the halogen lamp 120 in positions longitudinally outward of the heat generating portion H of the halogen lamp 120 such that radiant heat emitted from the heat generating portion H which would otherwise leak out in both longitudinally outward directions is reflected by the end reflecting portions 145 and directed longitudinally inward of the both ends of the reflecting plate 140. This makes it possible to effectively utilize the radiant heat that is prone to escape from the halogen lamp 120 in both longitudinally outward directions, irrespective of the width (size) of the sheet P. Since the nip plate 130 is effectively heated, the nip plate 130 can be quickly heated and thus the startup time of the fixing device 100 can be reduced.

Since each of the both end reflecting portions 145 has the reflecting surface 145A tilted with respect to the longitudinal direction of the halogen lamp 120, the radiant heat flowing in the longitudinally outward direction can be reflected by the both end reflecting portions 145 toward the nip plate 130. This makes it possible to utilize the reflected radiant heat without waste and to heat the nip plate 130 quickly, so that the startup time of the fixing device 100 can be reduced.

Since the nip plate 130 extends along the longitudinal direction of the halogen lamp 120 beyond the heat generating portion H, it is possible to provide a wide receiving surface for the radiant heat reflected by the reflecting plate 140, in particular by the both end reflecting portions 145 (at the reflecting surfaces 145A). Therefore, the reflected radiant heat can be utilized effectively.

Since the both end reflecting portions 145 are apart from the corresponding electrodes 124 because of the cut portions 145B, the both end reflecting portions 145 can be formed to cover the both end portions of the halogen lamp 120 so as to reduce the area of the openings through which the radiant heat leaks out. This makes it possible to effectively utilize the radiant heat that is prone to escape in the longitudinally outward direction.

Although an illustrative embodiment of the present invention has been described above, the present invention is not limited to this specific embodiment. It is to be understood that modifications and changes may be made to any of the specific configurations without departing from the scope of the present invention as claimed in the appended claims.

In the above-described embodiment, the central reflecting portion 144 extends along the longitudinal direction of the halogen lamp 120 (the heating element) in the region corresponding to the heat generating portion H (i.e., substantially at the same length of the heat generating portion H) and along the heat generating portion H, but the present invention is not limited to this specific configuration. For example, the central reflecting portion may extend along the longitudinal direction of the heating element in a region wider than that corresponding to the heat generating portion. In other words, according to the present invention, the central reflecting portion extends along the longitudinal direction of the heating element at least in the region corresponding to the heat generating portion of the heating element and along the heat generating portion.

In the above-described embodiment, each of the both end reflecting portions 145 has the reflecting surface 145A tilted with respect to the longitudinal direction of the halogen lamp 120, but the present invention is not limited to this specific configuration. For example, according to a reflecting plate 240 as shown in FIG. 6, each of both end reflecting portions 245 has a reflecting surface 245A perpendicular to the longitudinal direction of the halogen lamp 120.

With this configuration, when compared with the embodiment having a tilted reflecting surface, the reflecting plate can be readily formed by bending a single aluminum plate or the like. Further, since openings of a tube formed by the reflecting plate 240 (a central reflecting portion 144) and a nip plate (not shown) can be covered by the both end reflecting portions 245, most of the radiant heat which would otherwise leak out in both longitudinally outward directions can be reflected by the both end reflecting portions 245 and directed longitudinally inward of the both ends of the reflecting plate. This makes it possible to effectively utilize the radiant heat emitted from the halogen lamp 120.

Figure 6:
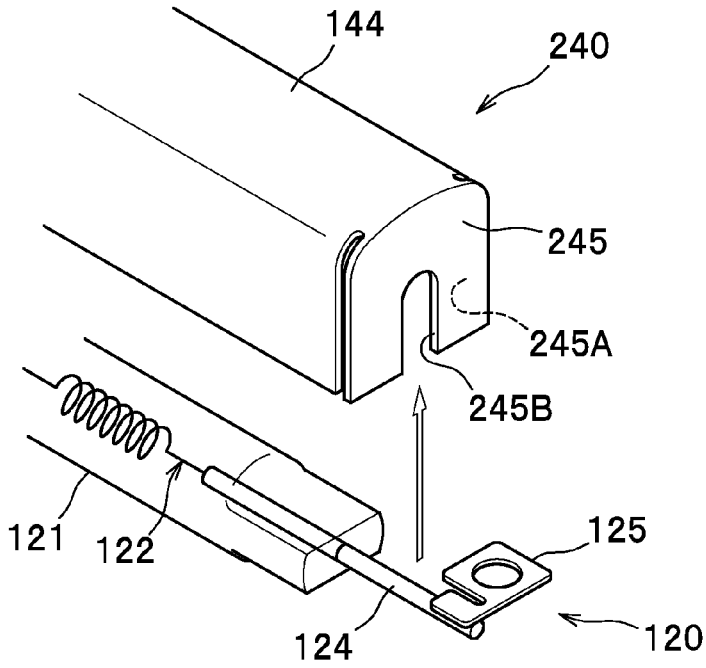
FIG. 6 is an explanatory view showing a reflecting plate according to a modified embodiment of the present invention.
Figure 7:
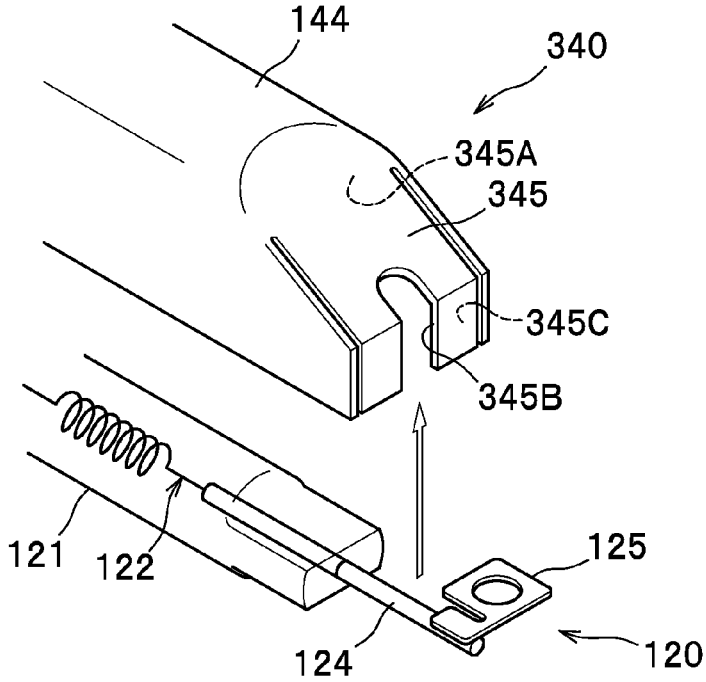
FIG. 7 is an explanatory view showing a reflecting plate according to another modified embodiment of the present invention.

In the above-described embodiment, each of the both end reflecting portions 145 has the reflecting surface 145A tilted with respect to the longitudinal direction of the halogen lamp 120, and in the embodiment as shown in FIG. 6, each of the both end reflecting portions 245 has the reflecting surface 245A perpendicular to the longitudinal direction of the halogen lamp 120, but the present invention is not limited to these specific configurations. For example, according to a reflecting plate 340 as shown in FIG. 7, each of both end reflecting portions 345 may have both a tilted reflecting surface 345A and a perpendicular reflecting plate 345C with respect to the longitudinal direction of the halogen lamp 120.

According to the above-described embodiments, cut portions 145B, 245B, 345B are provided so that the both end reflecting portions 145, 245, 345 can be disposed apart from the corresponding electrodes 124. However, the present invention is not limited to this specific configuration. For example, a through-hole for exposing the electrode may be formed in each of the both end reflecting portions so that the both end reflecting portions are apart from the corresponding electrodes.

In the above-described embodiments, the halogen lamp 120 (halogen heater) is employed as an example of a heating element, but the heating element consistent with the present invention is not limited thereto. For example, an infrared heater or a carbon heater may be adopted, instead.

In the above-described embodiment as shown in FIGS. 2 to 5, the central portion 131A of the nip plate 130 (the base portion 131) is formed by bending to have a downward protrusion extending downward from the both end portions 131B, but the present invention is not limited to this specific configuration. For example, the central portion may be formed by bending to have an upward protrusion extending upward from the both end portions. As an alternative, the nip plate 130 (base portion 131) may have a flat plate-like shape.

In the above-described embodiment, the pressure roller 150 is employed as an example of a backup member, but the backup member consistent with the present invention is not limited thereto. For example, a belt-like pressure member may be adopted, instead. Furthermore, in the above-described embodiment, the pressure roller 150 (backup member) is pressed against the nip plate 130 to form a nip portion for a sheet, but the present invention is not limited to this specific configuration. Instead, the nip portion may be formed by an alternative configuration in which the nip plate is pressed against the backup member.

In the above-described embodiment, as shown in FIG. 5, the stay 160 (contact portions 163) is non-continuously in contact with the reflecting plate 140 (flange portions 142) along the longitudinal direction, but the present invention is not limited to this specific configuration. For example, the stay may be continuously in contact with the reflecting plate along the longitudinal direction. Further, in the above-described embodiment, the stay 160 supports the nip plate 130 through the reflecting plate 140 (flange portions 142), but the present invention is not limited to this specific configuration. For example, the stay may directly support the nip plate.

In the above-described embodiment, the stay 160 is provided for ensuring the rigidity of the nip plate 130. However, the present invention is not limited to this specific embodiment. Namely, as long as a sufficient rigidity can be obtained by means of the rigidity of the nip plate by itself or the reflecting plate, the stay may be omitted.

In the above-described embodiment, a sheet P (e.g., of paper) is used as an example of a recording sheet, but the recording sheet consistent with the present invention is not limited thereto, and an OHP sheet or the like may be adopted.

The fusing film or fusing member may be a film (e.g., of resin or metal), or a film of which an outer surface is covered with a rubber layer.

In the above-described embodiment, the fixing device 100 is described as being included in the laser printer 1 by way of example. The present invention is however not limited to this example. Alternatively, the fixing device consistent with the present invention may be used in an LED printer in which an exposure is performed using LEDs, or used in any other known image forming apparatuses such as photocopiers, multifunction peripherals, etc. Furthermore, the above-described embodiment describes a monochrome image forming apparatus, but the present invention is not limited thereto. The image forming apparatus to which the fixing device according to the present invention is applicable may be a color image forming apparatus.

What is claimed is:

1. A fixing device for thermally fixing a developer image transferred onto a recording sheet, comprising:

a tubular fusing film;

a heating element extending longitudinally and disposed inside the fusing film;

a nip member disposed in such a manner as to contact with an inner surface of the fusing film and to allow the fusing film to slide along the nip member;

a reflecting plate extending along the heating element and configured to reflect radiant heat from the heating element in a direction toward the nip member; and a backup member configured to nip the fusing film with the nip member to thereby form a nip portion for the recording sheet between the fusing film and the backup member, wherein the reflecting plate includes:

a central reflecting portion extending along a longitudinal direction of the heating element at least in a region corresponding to a heat generating portion of the heating element and along the heat generating portion; and end reflecting portions stationarily provided on both longitudinal ends of the central reflecting portion and tilted inward relative to the central reflecting portion, the end reflecting portions being disposed, with respect to the heating element, in positions longitudinally outward of the heat generating portion.

2. A fixing device according to claim 1, wherein the reflecting plate is made from a metal plate, and wherein the end reflecting portions are formed integrally with the central reflecting portion by pressing the metal plate.

3. A fixing device according to claim 1, wherein the heating element comprises a glass tube and a heating resistor disposed inside the glass tube.

4. A fixing device according to claim 1, wherein the nip member is a nip plate.

5. A fixing device according to claim 4, wherein the nip plate extends along the longitudinal direction of the heating element beyond the heat generating portion.

6. A fixing device according to claim 1, wherein each of the end reflecting portions has a reflecting surface orthogonal to the longitudinal direction of the heating element.

7. A fixing device according to claim 1, wherein the heating element has a pair of electrodes disposed longitudinally outward of the heating element, and the end reflecting portions are spaced apart from the corresponding electrodes.

8. A fixing device according to claim 1, wherein the heating element has non-heat generating portions located longitudinally outward of the heat generating portion, and the end reflecting portions of the reflecting plate are disposed opposite to the non-heat generating portions.

9. A fixing device for thermally fixing a developer image transferred onto a recording sheet, comprising:

a tubular fusing film;

a heating element extending longitudinally and disposed inside the fusing film, the heating element having a heat generating portion and non-heat generating portions located longitudinally outward of the heat generating portion;

a nip member disposed in such a manner as to contact with an inner surface of the fusing film and to allow the fusing film to slide along the nip member;

a reflecting plate extending along the heating element and configured to reflect radiant heat from the heating element in a direction toward the nip member; and a backup member configured to nip the fusing film with the nip member to thereby form a nip portion for the recording sheet between the fusing film and the backup member, wherein the reflecting plate includes:

a central reflecting portion extending along a longitudinal direction of the heating element at least in a region corresponding to the heat generating portion; and end reflecting portions stationarily provided on both longitudinal ends of the central reflecting portion and opposite to the non-heat generating portions, the end reflecting portions being tilted inward toward the heat generating portion.

10. A fixing device according to claim 9, wherein the reflecting surface is tilted orthogonally with respect to the longitudinal direction of the heating element.

11. A fixing device according to claim 9, wherein the reflecting surface is tilted at more than two different angles.

12. A fixing device according to claim 9, wherein the nip member is a nip plate.

13. A fixing device according to claim 12, wherein the nip plate extends along the longitudinal direction of the heating element beyond the heat generating portion.

14. A fixing device according to claim 9, wherein the heating element has a pair of electrodes disposed longitudinally outward of the heating element, and wherein each of the end reflecting portions has one of a cut portion and a through-hole for exposing a corresponding electrode so that the end reflecting portions are spaced apart from the electrodes.

15. A fixing device according to claim 14, wherein the reflecting plate is made from a metal plate, and wherein the end reflecting portions are formed integrally with the central reflecting portion by pressing the metal plate.

16. A fixing device according to claim 14, wherein the heating element comprises a glass tube and a heating resistor disposed inside the glass tube.

17. A fixing device for thermally fixing a developer image transferred onto a recording sheet, comprising:

a flexible fusing member which is flexibly deformable;

a heating element extending longitudinally and disposed inside the flexible fusing member, the heating element having a heat generating portion and non-heat generating portions located longitudinally outward of the heat generating portion;

a nip member disposed in such a manner as to contact with a surface of the flexible fusing member and to allow the flexible fusing member to slide along the nip member;

a reflecting plate extending along the heating element and configured to reflect radiant heat from the heating element in a direction toward the nip member; and a backup member configured to nip the flexible fusing member with the nip member to thereby form a nip portion for the recording sheet between the flexible fusing member and the backup member, wherein the reflecting plate includes:

a central reflecting portion extending along a longitudinal direction of the heating element at least in a region corresponding to the heat generating portion; and end reflecting portions stationarily provided on both longitudinal ends of the central reflecting portion and opposite to the non-heat generating portions, the end reflecting portions being tilted inward relative to the central reflecting portion and toward the heat generating portion.

18. A fixing device according to claim 17, wherein the reflecting plate is made from a metal plate, and wherein the end reflecting portions are formed integrally with the central reflecting portion by pressing the metal plate.

19. A fixing device according to claim 17, wherein the heating element comprises a glass tube and a heating resistor disposed inside the glass tube.

* * * * *